US005979711A

United States Patent [19]

Fuchs et al.

[11] Patent Number: 5,979,711

[45] Date of Patent: Nov. 9, 1999

[54] DISPENSER FOR MEDIA

[75] Inventors: Karl-Heinz Fuchs, Radolfzell; Hans Merk, Gaienhofen, both of Germany

[73] Assignee: Caideil M.P. Teoranta, Tpurmakeady, Islamic Rep. of Iran

[21] Appl. No.: 08/803,044

[22] Filed: Feb. 19, 1997

[30] Foreign Application Priority Data

Feb. 22, 1996 [DE] Germany ..... 196 06 702

[51] Int. Cl.[6] ..... B05B 11/00

[52] U.S. Cl. ..... 222/321.2; 239/333

[58] Field of Search ..... 222/321.2; 239/333

[56] References Cited

U.S. PATENT DOCUMENTS

| | | | |
|---|---|---|---|
| 4,896,794 | 1/1990 | Banks et al. | 222/1 |
| 5,228,602 | 7/1993 | Maas et al. | 222/340 |
| 5,271,513 | 12/1993 | Crosnier et al. | 215/320 |
| 5,282,552 | 2/1994 | Ophardt | 222/181 |
| 5,441,174 | 8/1995 | Sperry | 222/105 |
| 5,444,145 | 8/1995 | Brant et al. | 526/348.3 |
| 5,478,890 | 12/1995 | Shinozaki et al. | 525/240 |
| 5,482,998 | 1/1996 | Muehlbach et al. | 525/66 |
| 5,629,059 | 5/1997 | Desai et al. | 428/34.9 |
| 5,642,860 | 7/1997 | Bush et al. | 239/333 |
| 5,741,564 | 4/1998 | Gillberg-LaForce | 428/35.2 |
| 5,759,569 | 6/1998 | Hird et al. | 424/443 |
| 5,807,946 | 9/1998 | Jourdain et al. | 526/282 |

FOREIGN PATENT DOCUMENTS 07207054 8/1995 Japan .

*Primary Examiner*—J. Casimer Jacyna
*Attorney, Agent, or Firm*—Quarles & Brady LLP

[57] ABSTRACT

In a device (1) suitable for discharging media or the like at least one springly deformable component (5, 6, 11, 40) consists of a copolymer produced with a co-catalyst such as titanocen, more particularly an ethylene α-olefine copolymer which may also be improved as regards its resiliency by gamma irradiation.

In a spiral spring (26, 39, 49) produced from this or a similar plastics material axially adjacent spiral sections are directly integrally connected to each other not only via the spiral but also along the circumference of the spring.

27 Claims, 4 Drawing Sheets

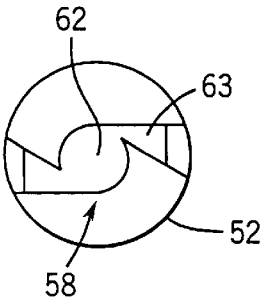
FIG. 4
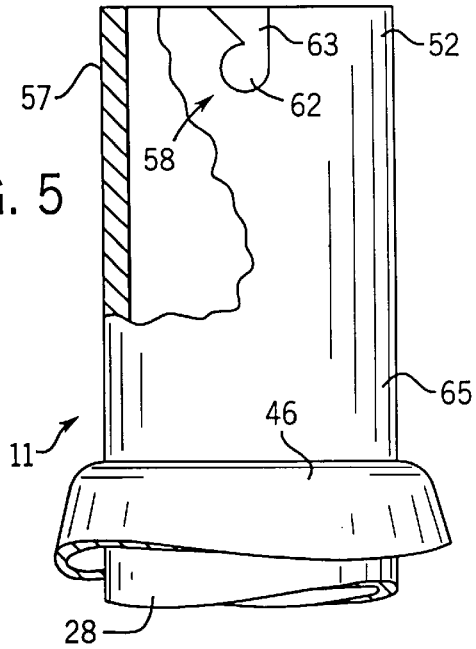
FIG. 5
FIG. 6
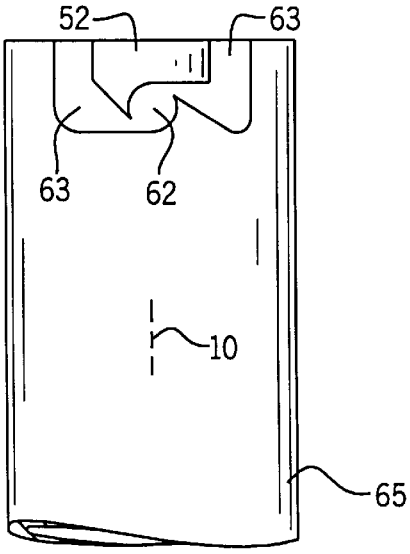
FIG. 7
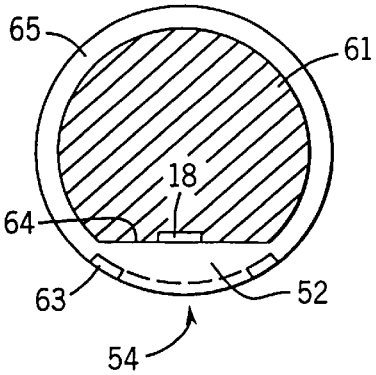

DISPENSER FOR MEDIA

TECHNICAL FIELD

The invention relates to a discharge device for media.

Springy components having elastic pliancy for discharge devices and other devices are mostly made of steel as spiral or coil compression springs so that for the small dimensions concerned the spring characteristic remains as consistent as possible and high resiliency is achieved even when the spring is permanently exposed to a high preloading and/or pronounced fluctuations in temperature. When the other components of the device are made of a plastics material, such a spring element is a nuisance to recycling.

On the other hand, there has been no way hitherto of producing springs of a plastics or thermoplastic material having the cited properties, more particularly very slim springy elements, the largest width or diameter amounting to less than 20 or 10 mm and/or the largest spring cross-section of which being two or one millimeter respectively.

OBJECT OF THE INVENTION

The invention is based on the object of defining a component of a thermoplastic material which avoids the drawbacks of known configurations or of the kind as described which, more particularly, features a high spring rigidity and which is required to consistently have maximum possible resiliency over its full spring travel even when exposed to substantially elevated temperatures.

SUMMARY OF THE INVENTION

In accordance with the invention a polymer or copolymer is used which when produced is brought together with a metallocene. The metallocen acts as a catalyst in production of the thermoplastic material. It can be used as a polymerization cocatalyst so that tiny thereof remain evenly distributed in the plastic material.

So that the metallocen develops as high a performance as possible it is expediently applied to a powdery, insoluble substrate and fixed thereon, each powder grain of the substrate forming in subsequent polymerization a start for the growth of polymer chains. Because several active centers on the surface of each grain are identical, all chains of molecules grow uniformly to the same length. The catalyst concerned is a transition metal complex such as titanium, zirconium or the like as the central atom and cyclopentadienylanalogen ligands on the metallocene. With such catalysts an ethylene copolymer can be produced with α-olefin in which the comonomer is configured highly homogenously. In addition to titanocens or zirconocens other catalysts are also feasible, where applicable.

Irrespective of the configuration described, more particularly in addition thereto, however, it may also prove advantageous to further improve the plastics material following polymerization by electron or gamma irradiation as regards the properties as explained. In particular, the surface structure, such as the surface density, but also the resiliency are enhanced thereby. Even after the component has been compressed many times only a very slight permanent distortion materializes. The discharge device or any other device containing the springy element may be irradiated not before it has been assembled so that all its components are exposed at the same time to the radiation. As the source of radiation a cobalt 60 source may be used and experience has shown that a radiation intensity of at least 85 kGy and 120 kGy at the most to be particularly effective. Due to the energy introduced into the material during irradiation, electrons are released from the molecules, as a result of which radicals materialize. In the case of a polyethylene having many side chains in the molecule relatively stable radicals result. These interreact by two reactive polyethylene molecules joining to form a further enlarged macromolecule and thus the mean molecular weight is increased. This radiation cross-linking is thus particularly suitable for springy elements which are permanently subjected to preloading or exposed to strongly alternating loads.

Due to the configuration in accordance with the invention the tendency towards stress cracking is also substantially reduced so that the component is suitable, despite strong alternating deformations on discharge of the medium, to always remain in contact with the medium without the risk materializing of it become unsterilized due to germs ingressing or clogging in the cracks. The component may also form to advantage sliding surfaces for operation of the discharge device, for example on a valve element, a plunger or the like. In particular, the component may be totally enclosed and concealed from the environment within a housing or chamber through which the medium flows or which is filled therewith. In this arrangement the component may be disposed so that all of its surfaces, for example inner and outer circumferential surface areas as well as inner and outer face surface areas are flushed by the medium. Further advantages or improvements of the stated kind will be appreciated from the features of the sub-claims.

In accordance with the invention the use of a plastics material produced in the manner described for components of discharge devices is proposed, particularly for components required to be resilient.

These and further features are also evident from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF TEE DRAWINGS

Example embodiments of the invention are explained in more detail in the following and illustrated in the drawings in which:

FIG. 1 shows an axial section of a discharge device according to the invention FIG. 2 is a further embodiment of a discharge device, FIG. 3 shows an axial section through a further embodiment, FIG. 4 is a face end view of the inner outlet or nozzle body as shown in FIG. 3, FIG. 5 is a section of a unit of the discharge device shown in FIG. 2 in a partially sectioned view, FIG. 6 shows a further embodiment of a unit according to FIG. 5 and FIG. 7 shows a unit according to FIG. 6 as viewed from above.

DETAILED DESCRIPTION OF THE PREFERRED EMBODIMENT

Figure 1:
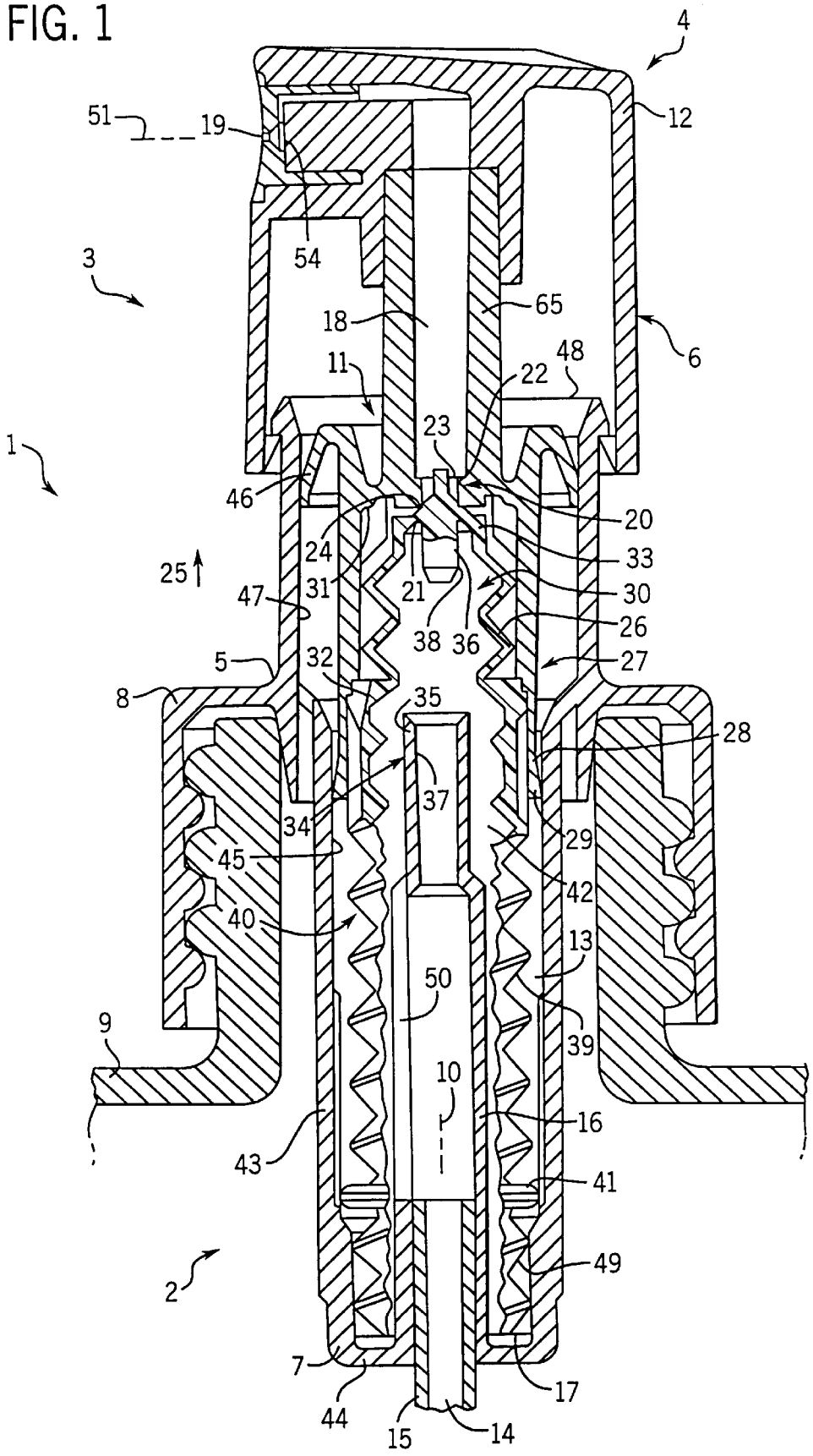

The discharge device may be configured in accordance with the patent application P 44 41 263.0, this being the reason why reference is made to this patent application as regards the features and effects of the present application.

The discharge device 1 comprises two units 2, 3 which can be moved manually with respect to each other over a working movement, such as a linear stroke, these units accordingly forming a discharge actuation 4. For actuation the discharge device is to be held in one hand and actuated by the fingers thereof so that it is shortened and thereby the medium therein subjected to a discharge pressure. Each of the units 2, 3 comprises a separate base body 5, 6 each of which is an integral component and which may form the outermost surface area of the device 1.

The elongated base body 5 of the inner unit 2 forms an elongated housing 7 which is to be secured by a fastener member 8 to the neck of a reservoir 9 firmly positioned so that it lies by the majority of its length within the vessel 9. The cited components are located in a middle or main axis 10 of the device 1.

The unit 3 contains an elongated displacement or piston unit 11 and a discharge or actuating head 12 located outside of the base body 5, 6, this head forming the base body 6. This base body 6 may be configured integrally with the unit 11 and form ed by a component separate from the latter. In the housing 7 an elongated pressure or pump chamber 13 is provided which is defined by its outer circumference as well as by its inner end of the housing and by the outer end of the unit 11. Outside of the inner end of the housing 7 an inlet 14 is provided for the pressure chamber 13 which may be formed by a filling or suction tube which directs the medium from the bottom region of the reservoir 9 by suction into the housing 7 and in the pressure chamber 13. From the inner end of the housing 7 protruding thereinto is a protusion or port 16 into which the medium flows from the outer end of the flexible tube 15. In the housing 7 a further inlet directly adjoining the pressure chamber 13 is provided, via which the medium output by the port 16 flows directly into the pressure chamber 13. The connection between inlet 14, 17 and pressure chamber 13 may be configured free of any valve or provided with a valve which closes when pressure builds up in the pressure chamber 13 and opens when a vacuum exists in the chamber 13 for drawing in a further medium charge.

Passing through the unit 6, 11, adjoining the chamber 13, is an outlet passage 18 via which the medium is supplied pressurized to the medium outlet 19 provided in the head 12. At the outlet 19 the medium is released from the device 1 to the environment. Between the chamber 13 and the passage 18 a closure 20, namely an outlet valve, is provided, the actuator 4 also forming a closure actuator for repeatedly opening and closing the closure 20. The closure 20 contains only two closure parts 21, 22 in each case with which a closure passage 23 directly adjoining the passage 8 can be closed pressure-tight in one position in the region of closing surfaces areas 24 and in the other position is opened so that the medium flows between the closing surfaces areas 24 from the chamber 13 into the passages 23, 28. The through-flow direction 25 of the closure 20 in this arrangement is from inside out, namely oriented so that the medium flows via the inlet 14 into the housing 7, out of the chamber 13 and along the passage 18. The actuator movement of the unit 3 is as compared to this oriented conversely. The closure part 21 totally located within the unit 11 is loaded by a spring 26 towards the closing position, this spring being mounted or retained totally at the unit 11. The unit 11 forms by its inner end a cup-shaped piston 27 having a cylindrical tubular piston cuff 28, the inner end of which is configured as a sealing lip 29, sealing off the chamber 13 throughout its circumference. At the outer end the piston 27 comprises a face end wall as a piston crown 31 which is located exclusively within the piston shell 28, forming the outer closure part 22 and through which the passage 23 passes centrally. The inner closure part 21 is locked in place by a sleeve-shaped and dimensionally rigid carrier body 32 with respect to the piston 27 so that it is able to execute axial relative movements with respect to the piston 27. The carrier body 32 engages, spaced away from the closure part 21, the inner circumference of the piston shell 28 rigidly positioned so that it protrudes beyond the sealing lip 29 into the chamber 13. The carrier body 32 is connected to the closure part 21 exclusively by the spring 26, these components possibly forming a preassembled or integral unit. To affect the opening movement of the closure part 21 against the force of the spring 26, which is always preloaded, when subjected to the vacuum in the chamber 13, a plunger 33 is provided which is expediently formed by the closure part 21 and is configured integrally therewith.

For the closure 20 delay means 30 are provided which cause the closure 20, on opening of the closure actuator 4, to remain open longer than would be the case if it would be controlled solely by the pressure in the chamber 13 acting on the plunger 33. This pressure drops below the operating pressure mostly on commencement of the return stroke of the unit 11 at the latest, so that then the spring 26 would return the closure 20 instantly to its closed position. This is prevented for a short time by the means 20 so that the closure 20 recloses not before part of the return stroke has been executed or at the end thereof, the volume of the chamber 13 being reduced by the working stroke and enlargened as of commencement of the return stroke. For the delay the unit 2 comprises a closure holder 34 when retains the closure part 21 in the open position with respect to the base body 5 even when the unit 3 executes relative movements or the return stroke and thus the closure part 22 is removed outwardly from the closure part 21.

The holder 34 comprises on the housing 7 and totally within the latter a holding member 35 which may be formed by the freely protruding and slightly constricted end of the port 16. The pin-shaped or tubular shaped holding member 35 may be closed circumferentially and open at the free end, it being located contactlessly within the chamber 11 at which it does not need to adjoin, with respect to which it is able to execute minor radial movements in all directions, however, due to the flexibility of the port 16. To retain the closure part 21 or the plunger 33 in the cited position a counter member 36 is provided which may be configured integrally with the parts 21, 33 and in the starting position as shown in FIG. 1 protrudes contrary to the direction 25 away from the closing surface area 24 with an intermediate spacing freely and coaxially against the holding member 35.

The members 35, 36 comprise complementary engaging or friction surface areas 37, 38 which, with the closure part 21 open, when the spring 26 is maximally tensioned, engage each other with a predetermined friction at the end of the actuating stroke of the actuator 4. The friction surface area 37 of the holding member 35 is formed by an inner circumference and the friction surface area 38 by an outer circumference. On actuation the friction surface area 38 approaches the friction surface area 37 from its spacing position until it glides into the holding member 35 via guide-in ramps and in the further course of this coupling and insertion movement the friction increases. At the end of this movement the counter member 36 is center-located by resting friction with respect to the holding member 35 and with respect to the body 5, 7 when the closure 20 is still closed.

When a compressible medium, such as air, is present in the chamber 13, the pressure build-up on the working stroke is not sufficient as a rule to open the closure part 21 or completely so that this air is able to escape sufficiently through the closure 20 into the passage 18. If the return stroke of the unit 6, 11 commences at the end of the working stroke the closure part 21 is first held in place by the friction surface areas 37, 38 with respect to the unit 5, 7 so that the closure part 22 is distanced from the closure part 21. At the same time the spring 26 urges the closure part 21 in the direction of the closure part 22 or the closing position to a degree in which the resting friction is overcome. The counter member 36 thus slides with reduction of the frictional force along the friction surface area 37 until it releases therefrom, the closure part 21 then being accelerated by the force of the spring 26 and translated free of friction into the closing position. In this closing position the closing surface areas 24 then come into contact with each other firmly positioned, whereby the closing surface areas may be formed by complementary conical surfaces areas and more particularly the closing surface area of the closure part 21 being an outer cone.

During the extended opening time of the closure 20 the trapped air has adequate time to expand and as a result of this to escape into the passage 18, this also being promoted by non-gaseous medium being drawn into the chamber 13 via the inlet 14, 17. This medium may flow from the end of the holding member 35 against the inner side of the piston 33 facing away from the control surface area. Since the friction surface areas 37, 38, in the unused condition of the device 1, are still dry, the friction is initially higher. The clamping seat between the friction surface areas 37, 38 is then wetted, however, by the cited means with the non-gaseous medium so that in the sense of a reduction in the frictional force by the medium a lubrication materializes which facilitates liberation by the closure holder 34. In addition, the friction surface areas 37, 38 may be configured so that they wear out relatively quickly after a few working strokes at least to the extent that following venting of the pressure chamber 13 the holding force is diminished to such an extent that the closure 20 closes at the end of the working stroke or at the commencement of the return stroke.

The pressure-dependent opening travel of the closure 20 is substantially smaller than the opening travel resulting from the means 30 so that when the opening pressure is attained in the chamber 13 the closure 20 opens in the way as described, before the closure holder 34 engages. To ensure, more particularly in the case of a large opening travel, a centered location of the closure part 21 in the sole closing position, members for centering slide guidance of the closure part 21, the spring 26 or the piston 33 may be provided, for instance, as guiding lands on the inner circumference of the shell 28, a centering projection protruding into the passage 23 in the closing position only, or the like. These members may remain engaged over the full opening travel of the pressure-controlled opening and disengage on opening by the means 30 so as to then assume the centered location on closing movement of the closure part 21 even when the closure part 21 approaches an off-center location with respect to the centering means.

The return movement of the units 2, 3 with respect to each other is caused by a return spring 39 located within the housing 7 in the axis 10 which, like the spring 26, is configured as a resiliently torsioned compression spring. Like the spring 26 and all carrier bodies 32, 41, the spring 39 defines the annular chamber 13 at the inner circumference and is supported by its corresponding end at the piston 27 via the carrier body 32. Its outer and inner width is greater than that of the spring 26 so that it is contactless with respect to the cylindrical bore or runway 45. The other end of the spring 39 is supported firmly positioned via the carrier body 41 by the inner circumference of the housing 7 spaced away from the housing bottom 44.

Belonging to a preassembled or integral unit 40 are the parts 21, 26, 32, 33, 39, 41 the carrier body 32, 41 in each case being connected by a snap-action connection or a press-fit to the inner side of the associated sleeve such that the medium is able to bypass the latter, namely along its outer circumference which, where needed, is provided with recesses or through-openings. Between the annular disk-shaped body 41 and the bottom 44 a tubular protrusion 49 is furthermore provided, which may have the same cross-sections as the spring 39 and which is shorter with respect thereto. The inner end of the protrusion 49 is preloaded to contact the lands at the inner side of the bottom 44 so that between the radial lands the transition 17 is formed via which the medium flows along the bottom 44 from the unit 40 radially outwards into the chamber 13. The protrusion 49 is part of the unit 40 and may centrally engage the inner circumference of the housing 7.

The unit 40 or the juxtaposed longitudinal sections thereof surround a chamber 42 which is conductingly connected to the chamber 13 only in the bottom region via the inlet 17. Protruding free of contact into the chamber 42 is the port 16 including the holding member 35 as well as the counter member 36 in the way as already described. Like the chamber 13, the chamber 42 too is constricted on the working stroke and expanded on the return stroke. Each of the longitudinal sections 26, 39, 49 located one after the other, defining the shell of the chamber 42, is formed by an axially compressible, resilient tube section, the outer circumference and/or inner circumference of which forms threadlike one or more pitch spirals, namely spiral grooves and spiral lands therebetween such that the shell thickness is approximately constant throughout. As compared to this the carrier body 32 or 41 feature a greater wall thickness, more particularly a greater shell thickness so that it is not elastically deformed in operation. Due to the pitch spirals the end of the spring 39 supported by the unit 11, 32 is twisted with respect to the unit 5, 7 about the axis by a predetermined amount, for example more than 30°. The frictional force between the end of the unit 40, 49 and the bottom 44 of the chamber 13 is only sufficient to cause the supported end of the section 49 to be included in the twist by an amount, small in comparison, of for example approximately 10°, before being rendered stationary, however. As a result of this the spring 39 retains, in addition to the axial return tension, a return torsion about the spring axis 10, as a result of which the spring force is elevated. Included in the rotation is that of one of the two carrier bodies 32, 41, especially the body 41. A corresponding torsional movement is also exceuted by the spring 26.

The shell 43 of the housing 7 defining the storage volume of the reservoir 9 by its outer circumference forms with the inner circumference also the runway 45 for the piston end 29 and translates integrally into the bottom 44 through which the tube 15 passes. Adjoining the bottom integrally is the port 16 into which the tube 15 protrudes in a press fit. Following the outer end of the runway 45 is a runway 47 which is widened with respect to the latter formed by the housing shell on which a further piston 46 of the unit 11 runs sealed throughout circumferentially so that this alone sufficies to close off tight the outer end 48 of the housing shell. The piston 46 is located axially spaced away from the piston lip 29 in the region of the piston crown 31 and is configured completely integrally with the piston 27.

As evident from FIG. 1 the port 16 or the holding member 35 protrudes into the piston 27 and the carrier body 32. A transfer opening 50, for example a longitudinal slot, passes through the shell of the port 16, this longitudinal slot being located spaced away from the holding member 35 and the outer end of which is provided in the region of the body 41. As a result of this the free end of the port 16 or the holding member 35 including the friction surface area 37 may be closed off throughout the circumference. This end forms a further face end opening or transfer opening. The through-flow cross-sections of the transfer openings are substantially greater than those of the inlet openings 17 so that the latter act like a throttle. When both chambers 13, 42 are completely filled with medium, on the working stroke the medium is forced from the chamber 42 via the transfer openings 50 back into the reservoir 9, whereas in the chamber 13 the overpressure is generated in the way as described by means of which the medium is forced on opening of the closure 20 to the outlet 19. In this arrangement the inlet 17 acts similar to a closed inlet valve so that the medium is unable to flow from the chamber 13 or only unsubstantially via the inlet 17 back into the chamber 42. On the return stroke medium flows, on the one hand, via the port 16 and the transfer opening 50 into the chamber 42 and, on the other, simultaneously from the chamber 42 via the inlet 17 into the chamber 13, as a result of which all chambers are refilled. If, in this arrangement, the closure 20 is temporarily still to be closed, then the medium outlet 19 acts like an outlet valve as a throttle through which air cannot be drawn into the medium spaces 13, 18 or only to an unsubstantial degree.

Figure 2:
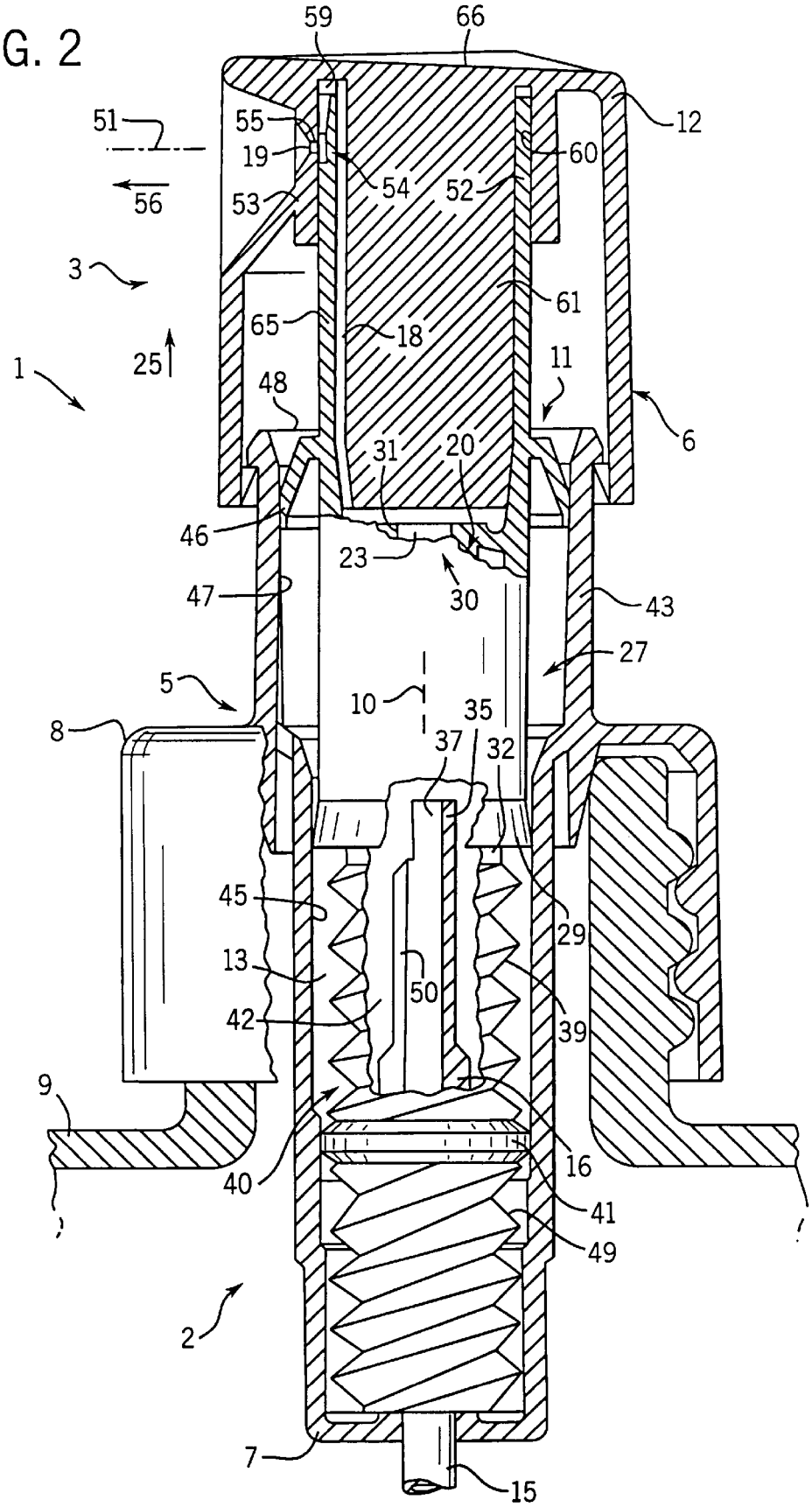

In the embodiment shown in FIG. 2 the holding member 35 or the friction surface area 37 is not configured throughout the circumference, but merely shell-like over an angle of curvature of more than 180°. In this arrangement the associated slot end of the transfer opening 50 may thus be opened or closed so that it does not adjoin a constricted tubular appendix as shown in FIG. 1. The carrier body 41 may also be configured so that it is included in implementing axial or rotary movements of the spring 39 and has only a centering effect so that the section 49 like the spring 39 serves as a return spring for the unit 3. The section 49 has in this arrangement roughly the same length as the spring 39.

Figure 3:
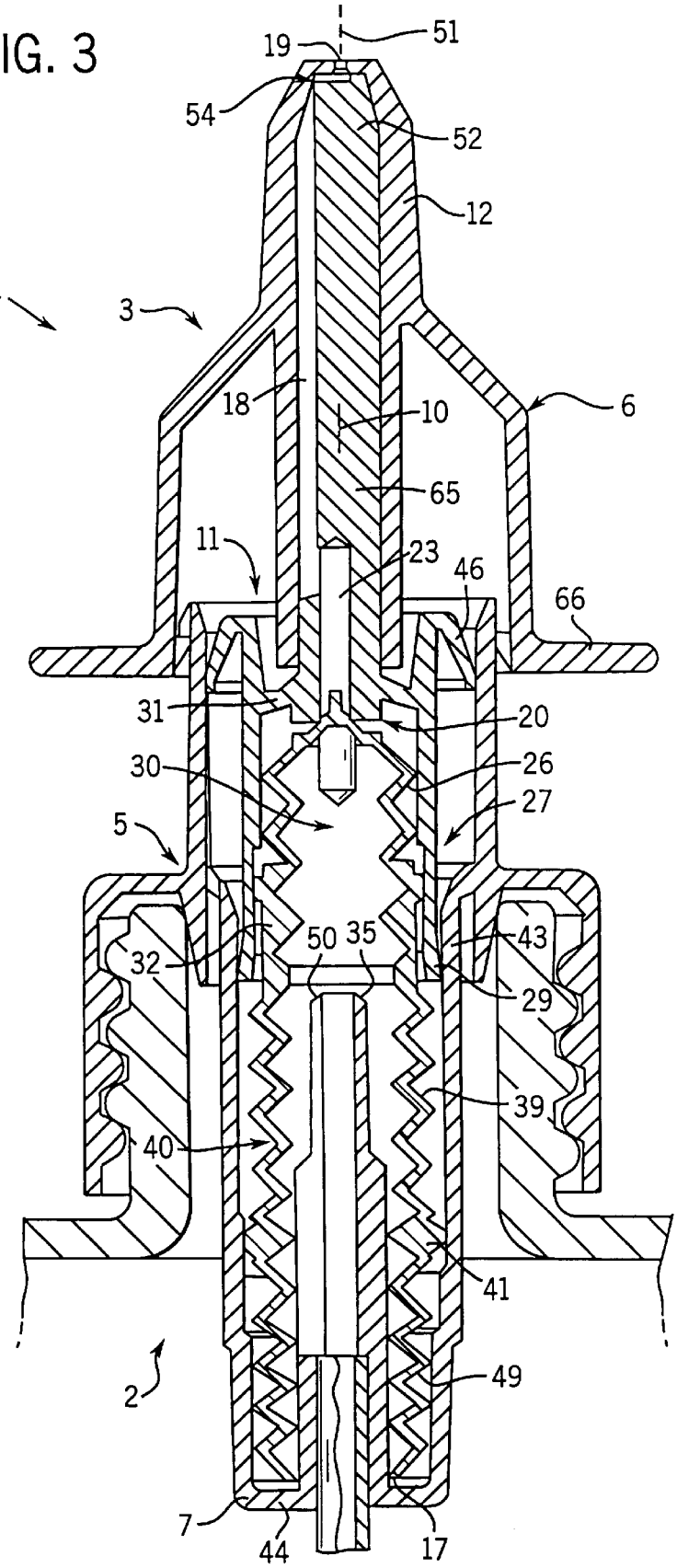

As evident from FIG. 3 in the starting position the holding member 35 does not protrude as far as into the piston 27, but in the final position of the working stroke also into the sections 26, 32. In this case the transition slot 50 passes through the holding member 35 up to the free end thereof. The carrier bodies 32, 41 protrude merely beyond the outer circumference of the springingly deformable sections 26, 39, 49. Via the chamber between the pistons 27, 46, defined annularly by the runway 47 and the shell 28, the reservoir 9 is vented. In this arrangement the piston 46 seals this chamber from the environment only in the starting position and opens up the openings in the actuated final position through which air is able to flow from without into this annular chamber and from there directly into the reservoir 9. The reservoir 9 is otherwise closed off tight by the base body 5 which for the reservoir opening formed by the neck of the reservoir comprises a circumferential seal configured integrally therewith.

As evident from the FIGS. 1 and 2 the outlet axis 51 of the outlet 19 is located transversely or at right angles to the axis 10 in the body 12, the direction of flow being oriented from the sole nozzle opening 19 away from the axis 10. The upstream located end of the end passage and nozzle passage 55 defined integrally directly adjoins a guide means 54 which as evident from FIG. 1 may be defined by the bottom of a dish-shaped nozzle cap and a nozzle core of an atomizer nozzle engaging the latter. The nozzle core is configured integrally with the body 6, 12 and the nozzle cap oriented against the axis 10 is inserted in a ring-groove shaped mount of the head 12 so that the medium flows therein oriented against the axis 51 of the guiding means, affecting in the guiding means a rotational flow about the axis 51 and is then deflected transversely or at right angles directly into the nozzle passage which may adjoin the guiding means by a section constricting in the direction flow. As is evident from FIG. 1 the guiding means is formed by a recess which is provided exclusively at the inner circumference of the dish shell and at the bottom surface area of the dish bottom of the nozzle body, whereby the nozzle passage passes through this bottom.

As evident from FIG. 2 the outer or second outlet or nozzle body 53, through which the straight end passage 55 and the opening 19 pass, is configured integrally with the bodies 6, 12, whilst the inner, first outlet body 52 is configured integrally with the unit 11 or at least one of the sealing members 29, 46 and is covered by the latter outwardly completely from the outer circumference of the bodies 5, 6. The recess 58, the bottom and side surfaces areas of which form the guiding surfaces areas of the means 54, is provided exclusively in the outer circumferential surface area 57 of the body 52 which is configured about the axis 10 sleeve-shaped or formed by a defined and thickened circumferential section of a sleeve shell. The recess 58 is defined at the outer circumference 57 by the inner or circumferential surface area of the body 53 which is likewise formed by a circumferential section of an integral sleeve and protrudes from the outermost face end wall of the body 12 contrary to direction 25 freely into the head 12. Within this sleeve a pin-shaped core body 61 likewise configured integral with the body 12 protrudes from the inner side of the face end wall of the body 12 and sealingly engages by its outer circumference the inner circumference of the body 52. The sleeve 53 and the carrier body 56 define a groove-shaped mount 60 defined by its groove flanks about the axis 10, at the groove flanks of which the body 52 is arranged firmly seated by its inner and outer circumferential surface area as a press-fit seal. The outlet passage 18 is practically defined by the passage 23 and the bottom 31 emanating from the inner circumference of the body 52 and by the outer circumference of the body 61 as well as being formed by a groove which may be exclusively provided in the core body 61. Between the bottom of the groove 60 and end edge of the body 52 located directly opposite a spacing is provided so that here a transverse passage 59 is formed between the end of the outlet passage 18 and in inlet of the guiding means 54. The transverse passage 59 may be configured annular throughout about the axis 10. As evident from FIGS. 5 to 7 the recess 58 forms in the axis 51 a swirl chamber 62 open only at the circumference and towards the nozzle passage 55, in which tangentially one or more swirl passages 63 port. Each groove-shaped swirl passage 63 extends up to the end edge of the body 52 and is thus directly connected to the transverse passage 59. Due to orienting surface areas the bodies 6, 12, 61 may be axially connected together with the body 11, 52 only in a single rotary position about the axis 10 so that the axes of the means 54 and of the passage 55 coincide. The medium flows from the passage 23 in the direction 25 directly against the free end surface area of the body 61, is deflected between the end surface area and the bottom 31 transversely to the axis 10 to the inlet of the passage 18 and flows therein again in the direction 25 to the transverse passage 59. In the transverse passage 59 the medium flows circumferentially as well as transversely to axis 10 alone the end edge of the body 52 directly into the inlet of the guiding passage 63 and therein against direction 25 to the chamber 62.

The unit 11 comprises a sleeve-shaped piston stem 65 configured integrally, connected directly to the head 12, which as evident from FIG. 1 totally defines the associated section of the passage 18, whilst it, as shown in FIG. 2, defining the latter only at the open longitudinal side of the groove 18. As illustrated in FIG. 2 the body 52 is formed by the outer end section of this stem 65, it substantially having the same inner and/or outer width as the remaining stem 65. The flat, circular section-shaped surfaces areas 64 lie roughly symmetrical as regards the axial plane of the means 54 which is related to the axis 10, so that the outlet passage 18 passes therethrough. For its assembly the body 52 is inserted into the body 53 in the direction 25 transversely to the axis 51. The outer face end surface area of the bottom wall of the head 12 facing away from the body 52 forms the handle 66 thereof for actuating the discharge device. In the starting position the units 2, 3 are defined with respect to each other by the force of the spring 39 so that the body 6 having stops at the end of the cap shell engages counterstops at the end 48 of the housing 7. Between the end of the sleeve 53 and the end 48 lies the stem 65 with its outer circumference within the outermost shell of the head 12 totally free so that, when actuated, it is able to travel into the housing 7 whilst the head shell tightly clasps the housing 7 at the outer circumference.

As evident from FIG. 3 the outlet axis of the opening 19 is located roughly parallel to in the axis 10 at the outermost end of the head 12 which forms a discharge port for introduction into a body cavity, for example a nasal cavity. The central stem 65 configured integrally with the body 52 and protruding as of the bottom 31 freely from the remaining unit 11, defines the passage 18 only in the region of the passage 23 completely. From the passage 23 a transverse passage leads into the groove 18, so that the outlet passage is defined from this transverse passage up to the inlet of the guiding means 54 by the outer circumference of the unit 52, 65 and by the inner circumference of the head 6, 12. This head comprises in an elongation of the nose port and in a spacing within its outermost shell an inner sleeve extending contrary to direction 25 freely protruding almost up to the bottom 31, this inner sleeve accommodating the stem 65.

The recess 58 of the guiding means 54 is, as shown in FIG. 4, provided exclusively in the outermost end surface area of the stem 52, 65 so that the passages 63 connect the outer circumference of this stem to the guiding chamber 62. The outer nozzle body is, in this case, formed by the end and face end wall of the head and nose port, as compared to which the handle 66 is set back contrary to the direction 25 and is located on both sides of the axis 10.

As evident from FIG. 5 a sole passage 63 connects the end edge of the body 52 to the chamber 62, the straight passage 63 to the chamber 62 may be constricted in the width and/or depth. As shown in the FIGS. 6 and 7 two separate passages 63 adjoining the annular passage 59 are provided for the chamber 62, both of these passages being located on both sides of the chamber 62 and each of which are angular-shaped. In one angular leg the medium flows from the passage 59 contrary to direction 25 and in the directly adjoining angular leg circumferentially towards the chamber 62, these angular legs of the two passages 63 being oriented against each other but porting into the chamber 62 with a swirling effect likewise oriented.

Each of the components of the discharge device 1 described may be fabricated of a plastics material, more particularly by injection molding, which to advantage is provided in addition to the polymer with an aggregate not consisting of a plastics material, especially one containing a metal or effective as a catalyst, namely a metallocene. The catalyst present merely in a trace amount serves to start or accelerate polymerization, as a result of which also all resulting chains of molecules are roughly the same in length and producing a very tight molecular weight distribution. The co-catalyst, the transition metal complex contained therein or the metal itself may be contained in a percentage by weight of less then 1/10000000 or 5/10000000 in the plastics material so that the catalyst can remain in the finished component. When the catalyst has had effect it could also, however, be separated from the plastics material.

A plastics material containing polyolefin or ethene, is preferred, more particularly a polyethylene or an olefin polymer or olefin copolymer is employed, resulting in an elastomer. The metallic percentage of the metallocene may be titanium or zirconium alone or a mixture thereof where a titanocen or zirconocen is involved, this resulting in a particularly good cross-linking in the transition from the monomeric to the polymeric molecular structure or in the chaining of the molecules. A further improvement may be achieved by the plastics material containing as the molecular structure instead of a pure polymerisate a copolymer e.g. of ethylene and olefin, the percentage by weight of the α-olefin expediently being at least 3% and 40% at the most, more particularly at least 5% and 30% at the most. The α-olefin has expediently two to six atoms of carbon.

By these configurations a substantially improvement of the plastics material can be achieved which is also easy to recycle. The plastics material is highly resistant to solvents or chemicals and has high softening temperatures, it containing few extractable components. In addition, the plastics material has no smell and no taste. It exhibits a high shock toughness, a good or dense surface quality, a low tendency to distort at elevated temperatures and a very good resistance to stress cracking.

These properties may be further improved by exposing the finish molded component to radiation, more particularly to gamma radiation, the intensity of which should be expediently at least 85 kGy and 120 kGy at the most, more particularly approximately 100 kGy. As a result of this the cross linking of the chains of molecules or the gel percentage of the plastics material can also be substantially enhanced. The cited properties are substantially improved especially as compared to plastic materials produced by hitherto conventional catalyst systems, for example with so-called Ziegler-Natta or Phillips catalysts.

Exposing the component to radiation by an electron beam accelerator may be done individually or not before it has been assembled with at least one further component or on completion of assembly of all components of the discharge device 1 so that irradiation is very simple to implement and has a sterilizing effect. All components of the device 1 consist of a plastics material so that they can be recycled in common.

Since due to this material also a very high resiliency of the component is achieved, it is preferably suitable for the springs 26, 39, 49, the sealing members 29, 46 or for the corresponding units 11, 40, whilst the remaining components may be produced of a plastics material having no aggregate. The spring in each case is configured as a kind of spiral spring, the windings of which adjoin each other not only along the spiral pitch, but are also connected to each other integrally transversely thereto via connecting sections which as compared to the spiral pitch exhibit a steeper pitch or form along the circumference of the spring the axial connections between adjacent spiral sections. As a result of this the spring may be configured as a kind of bellows. Also the carrier bodies 32, 41, the valve element 21 or 22, the plunger 33, the counter member 36 and the stem 65 including the outlet body 52 may consist of the enhanced plastics material. All features may be provided in the case of all embodiments, this being the reason why all passages of the description apply accordingly for all embodiments. The stated properties and effects may be provided precisely or merely roughly or substantially as explained.

We claim:

1. A dispenser for discharging media comprising:

at least one component consisting of recyclable thermoplastic material, said at least one component including a length section (65; 21, 32, 33, 36, 41) and a spring section (29, 46; 26, 36, 49) longitudinally directly connecting to said length section, said length section being inherently stiff, wherein said thermoplastic material comprises a copolymer of polyethylene and olefin-polymer formed while in presence of a catalyst comprising a metallocene.

2. The dispenser according to claim 1, wherein said olefin-polymer contains an olefin-copolymer.

3. The dispenser according to claim 1, wherein said component in one part comprises:

said spring section which is disposed in an interior of said dispenser, said spring section including a compression spring, a sealing element (21) carried on said compression spring, and said length section including a support body (32) supporting said compression spring (26, 39) and said sealing element (21), said sealing element (21) being spaced from said compression spring.

4. The dispenser according to claim 1, wherein said thermoplastic material is molecularly cross-linked through polymerization.

5. The dispenser according to claim 4, wherein said olefin-polymer is an α-olefin.

6. The dispenser according to claim 5, wherein within said thermoplastic material a percentage by weight of said α-olefin is between 5 and 30%.

7. The dispenser according to claim 4, wherein said olefin-polymer is an α-olefin with two to six atoms of carbon.

8. The dispenser according to claim 4, wherein said dispenser includes a plurality of said components consisting of a material comprising said olefin polymer, and an olefin copolymer including said polyethylene, said components including first and second components (11, 40), said length section (32) of said second component circumferentially directly connecting to said spring section (28, 29) of said first component (11).

9. The dispenser according to claim 1, wherein said thermoplastic material is an ethylene-α-olefin copolymer.

10. The dispenser according to claim 1, wherein said thermoplastic material contains traces of the catalyst.

11. The dispenser according to claim 1, wherein said ethylene-copolymer includes an extremely tight molecular weight distribution.

12. The dispenser according to claim 1, wherein said dispenser includes a plurality of said components consisting of said recyclable thermoplastic material, said components including separate first and second components assembled to provide said dispensers, said spring section including first and second spring sections (29, 26, 39, 49), said length section including first and second length sections (65, 32), said first component (11) including said first spring section (29) and said first length section (65), said second component including said second spring section (26, 39, 49) and said second length section (32) directly connecting to said first spring section (29), each of said first and second components being made in one part.

13. The dispenser according to claim 1, wherein said metallocene includes a central atom from at least one of a titanocen, and a zirconocen, cyclopentadienylanalogen ligands being provided on the metallocene.

14. The dispenser according to claim 1, wherein said component is a slide component which is at least partly tubular, said slide component including a friction member (29, 46, 36) that is frictionally stressed during operation, said spring section and said length section being annular.

15. The dispenser according to claim 1, wherein said spring section includes an axially operating return spring (26, 39) for a slide piston (27), and a valve (20).

16. The dispenser according to claim 1, wherein said olefin-polymer defines a percentage by weight of said thermoplastic material, said percentage of weight being in a range below 40% to 30%.

17. A dispenser for discharging media comprising:

a plurality of components assembled to an operational state, said components (5, 6, 11, 40) consisting of a recyclable thermoplastic material comprising a polymeric material formed while in presence of a catalyst comprising a metallocene, said polymeric material including chains of molecules cross-linked by polymerization, said polymer being irradiated for enhancement of cross-linking of molecules in said polymeric material, said components including a length section (65; 21, 32, 33, 36, 41) and a spring section (29, 46; 26, 39, 49), longitudinally directly connecting to said length section, said length section being inherently stiff, said spring section being axially and radially compressible.

18. The dispenser according to claim 17, wherein when in said assembled state said components define a total number of components and surface densities, said total number of components being made from said thermoplastic material, said surface densities being enhanced with said irradiation, said components including an actuating body (11) and a restoring body (40) separate from said actuating body (11), said actuating body (11) including a piston lip (29) for pressurizing the medium and a hollow shaft (65) for actuating said piston lip (29), said hollow shaft (65) being inherently stiff and operationally traversed by the medium, said restoring body (40) including a spring section (26, 39, 49) and a rigid section (21, 32, 41) longitudinally connecting to said spring section, said actuating body (11) being made in one part and said restoring a body (40) being made in one part.

19. A dispenser for discharging media comprising:

a base body (5, 6), a valve (20) with a valve body (46, 21), a casing (7), and a component (11, 40) including said valve body (46, 21), wherein within said base body (5, 6), said component (11, 40) is located inside said housing (7), commonly with said valve body (46, 21), said component being made in one part and at least partly displaceable with respect to said base body, in operation said component being exposed to the medium, said component and said valve body consisting of a recyclable thermoplastic material comprising a polymer formed while in presence of a catalyst comprising a metallocene, said component including a length section (65, 33) directly connecting to said valve body (46, 21), said valve body including a freely projecting skirt (46) spacedly enveloping said length section (65) and connecting to said length section with an annular end wall, said length section (65) being inherently stiff wherein said thermoplastic material comprises a copolymer of polyethylene and olefin-polymer.

20. A dispenser for discharging media comprising:

at least one component consisting of a remeltable and reformable thermoplastic material comprising a polymer produced under presence of a metallocene, wherein said component (40) includes a torsion spring (26, 39, 49), said component including an inherently stiff section (21, 32, 41) longitudinally directly connecting to said torsion spring in one part.

21. A dispenser for discharging media comprising:

at least one component made from a recyclable thermoplastic material including a polymer produced in presence of a metallocene, a pump chamber (13), and an annular piston lip (29) bounding said pump chamber (13) and slidably displaceable for volumetrically varying said pump chamber (13), wherein said at least one component (11, 40) extends inside said pump chamber (13) and bounds said pump chamber (13), said at least one component (11) including an inherently stiff length section (65) directly connecting to said piston lip (29, 46) in one part, said piston lip (29, 46) freely projecting from said inherently stiff length section (65) wherein said thermoplastic material comprises a copolymer of polyethylene and olefin-polymer.

22. The dispenser according to claim 21, wherein said pump chamber (13) is bounded by a housing (7) defining a length extension, said component (40) extending over most of said length extension, said component (46) including resilient compression springs (26, 39, 49) and an inherently stiff jacket (32) located between said resilient compression springs and directly connecting to said resilient compression springs in one part.

23. A dispenser discharging media, comprising:

at least one component made from a recyclable thermoplastic material including a polymer produced under presence of a metallocene, wherein said component (40) defines a length extension, along said length extension said component (40) including at least one inherently stiff component section (32, 41) and at least one compression spring (26, 39, 49), said component section (32, 41) being spaced away from both ends of said component (40).

24. A dispenser for discharging media comprising:

first and second components (11, 40) made from a thermoplastic material including a polymer produced under presence of a metallocene, a pump chamber (13), and a piston lip (29) bounding said pump chamber (13) and slidably displaceable for volumetrically varying said pump chamber (13) with a sliding face, said first component (11) including said piston lip (29) and said sliding face, an annular piston sleeve (28) including said piston lip (29) and an inner circumferential face, said second component including a support core (32) which is inherently stiff and rigidly connects to said inner circumferential face wherein said thermoplastic material comprises a copolymer of polyethylene and olefin-polymer.

25. A dispenser for discharging media comprising:

a component (11, 40) formed of a recyclable thermoplastic material including a polymer produced under presence of a metallocene, wherein said component (11, 40) includes separately operating springs (26, 39, 49) which are permanently pretensioned and axially juxtaposed parallel to a length extension of said springs, at least two of said springs being axially compressible independent from each other.

26. A dispenser for discharging media comprising:

at least one component consisting of recyclable thermoplastic material, wherein said thermoplastic material comprises a copolymer of polyethylene and olefin-polymer formed while in presence of a catalyst comprising a metallocene; and wherein said component includes a helical spring (26, 39, 49) including full spring turns spacedly separated from each other in an axial direction of said spring, said full springs turns being spirally interconnected by spiral structure to thereby form a bellows.

27. A dispenser for discharging media comprising:

a plurality of components assembled to an operational state, said components (5, 6, 11, 40) consisting of a recyclable thermoplastic material comprising a polymeric material formed while in presence of a catalyst comprising a metallocene, said polymeric material including chains of molecules cross-linked by polymerization, said polymer being irradiated for enhancement of cross-linking of molecules in said polymeric material;

wherein when in said assembled state said components define a total number of components and surface densities, said total number of components being made from said thermoplastic material, said surface densities being enhanced with said irradiation; and wherein said irradiation defines a radiation density of at least 85 kGy, said chains of molecules including side chains and providing radicals by the irradiation, thereby generating radical polyethylene molecules, in each case two of said radical polyethylene molecules being cross-linked by the irradiation to provide a macromolecule.

* * * * *